US010726763B2

(12) United States Patent
Zhang

(10) Patent No.: US 10,726,763 B2
(45) Date of Patent: Jul. 28, 2020

(54) METHOD FOR UPDATING MURA COMPENSATION DATA OF DISPLAY PANELS

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventor: Hua Zhang, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 328 days.

(21) Appl. No.: 15/752,143

(22) PCT Filed: Jan. 17, 2018

(86) PCT No.: PCT/CN2018/073092
§ 371 (c)(1),
(2) Date: Feb. 12, 2018

(87) PCT Pub. No.: WO2019/109477
PCT Pub. Date: Jun. 13, 2019

(65) Prior Publication Data

US 2020/0135087 A1 Apr. 30, 2020

(30) Foreign Application Priority Data

Dec. 6, 2017 (CN) ..... 2017 1 1278352

(51) Int. Cl.
*G09G 3/36* (2006.01)
*G09G 3/20* (2006.01)

(52) U.S. Cl.
CPC ..... *G09G 3/2092* (2013.01); *G09G 2310/08* (2013.01); *G09G 2320/0233* (2013.01); *G09G 2320/0626* (2013.01); *G09G 2360/18* (2013.01)

(58) Field of Classification Search
CPC ... G09G 3/36; G09G 3/00; G09G 3/32; G06F 3/041; G06F 3/045; G01R 27/26; G06K 11/06; G08C 21/00
See application file for complete search history.

(56) References Cited

U.S. PATENT DOCUMENTS

2008/0001886 A1 1/2008 Kim et al.
2017/0206821 A1* 7/2017 Lee ..... H01L 27/1274
(Continued)

FOREIGN PATENT DOCUMENTS

CN 102446479 A 5/2012
CN 102855856 A 1/2013
(Continued)

*Primary Examiner* — Pegeman Karimi
(74) *Attorney, Agent, or Firm* — Hemisphere Law, PLLC; Zhigang Ma

(57) ABSTRACT

A method for updating MURA compensation data of a display panel includes: disabling a MURA compensation function of a timing controller such that the image of the display panel is an original image without MURA compensation, wherein the timing controller is connected to a memory; disconnecting the timing controller from the memory; erasing an original MURA compensation data in a memory and simultaneously obtaining a new MURA compensation data according to the original image of the display panel; and writing the new MURA compensation data into the memory. In this manner, during the time when the original MURA compensation data in the memory is erased, a new MURA compensation data can also be written into the memory such that the production efficiency of the display panel can be increased.

12 Claims, 4 Drawing Sheets

(56) References Cited

U.S. PATENT DOCUMENTS

| | | | | |
|---|---|---|---|---|
| 2018/0322834 | A1* | 11/2018 | Zhang | G09G 3/2007 |
| 2018/0342211 | A1* | 11/2018 | Zhang | G09G 3/34 |
| 2019/0088195 | A1* | 3/2019 | Khazeni | G09G 3/32 |

FOREIGN PATENT DOCUMENTS

| | | | |
|---|---|---|---|
| CN | 103903545 | A | 7/2014 |
| CN | 105244004 | A | 1/2016 |
| CN | 105390111 | A | 3/2016 |
| CN | 105427822 | A | 3/2016 |
| CN | 106847224 | A | 6/2017 |
| CN | 107170415 | A | 9/2017 |

* cited by examiner

METHOD FOR UPDATING MURA COMPENSATION DATA OF DISPLAY PANELS

RELATED APPLICATIONS

The present application is a National Phase of International Application Number PCT/CN2018/073092, filed Jan. 17, 2018, and claims the priority of China Application No. 201711278352.3, filed Dec. 6, 2017.

FIELD OF THE DISCLOSURE

The disclosure relates to the display technology field, and more particularly to a method for updating MURA compensation data of display panels.

BACKGROUND

In a display panel, the driving code of a timing controller (TCON IC) is generally stored in a flash having a small storage. However, the MURA (i.e. the non-uniform brightness) compensation data is large, and thus a flash having a large storage is required. To reduce the cost, the driving code of the timing controller and the MURA compensation data of the display panel are stored in one flash having a large storage, wherein in the flash, the driving code of the timing controller and the MURA compensation data of the display panel are well allocated. In this manner, the timing controller can read its driving code and the MURA compensation data of the display panel through the same circuit.

The driving code of the timing controller will not vary and is previously stored in the flash, and thus it takes no production time of the display panel.

Different display panels have different MURA compensation data. During the production process, each of steps including erasing, original MURA data obtaining, data processing and data recording is essential and takes time.

The "erasing" step is to erase old MURA compensation data or wrong MURA compensation data left in the flash, so that an original MURA data can be obtained without effects. In this step, the SPI circuit between the timing controller and the flash needs to be shut down (i.e. the timing controller is disconnected from the flash). When the "erasing" step is completed, the timing controller is restarted, the SPI circuit between the timing controller and the flash is started up (i.e. the timing controller is reconnected from the flash). Then, the timing controller reads data in the flash (old MURA compensation data or wrong MURA compensation data has been erased), and the image of the display panel is an original image without MURA compensation. At this time, the following process can be continued, such as generating and storing a new MURA compensation data. If the time taken by "erasing" step can be well used, the production efficiency of display panels is likely to be increased.

SUMMARY

To solve the above mentioned problems, the present disclosure provides one method for updating MURA compensation data of a display panel.

The method for updating MURA compensation data of the display panel provided by the present disclosure includes: disabling a MURA compensation function of a timing controller such that the image of the display panel is an original image without MURA compensation, wherein the timing controller is connected to a memory; disconnecting the timing controller from the memory; erasing an original MURA compensation data in a memory and simultaneously obtaining a new MURA compensation data according to the original image of the display panel; and writing the new MURA compensation data into the memory.

In one embodiment of the method for updating MURA compensation data of the display panel provided by the present disclosure, the step of disabling the MURA compensation function of the timing controller includes: revising a register allocation data in a buffer of the timing controller through an I2C board such that the MURA compensation function of the timing controller is disabled. It should be noted that, the MURA compensation function of the timing controller is disabled or enabled according to the register allocation data.

In one embodiment of the method for updating MURA compensation data of the display panel provided by the present disclosure, the timing controller is connected to the memory through a SPI circuit. The step of disconnecting the timing controller from the memory includes: converting a SPI enable signal received by a SPI enable pin of the timing controller from a high level to a low level so that the SPI circuit is shut down. In addition, the timing controller is reconnected to the memory when the SPI enable signal received by the SPI enable pin of the timing controller from a low level to a high level.

In one embodiment of the method for updating MURA compensation data of the display panel provided by the present disclosure, the method further includes: restring the timing controller. The step of restring the timing controller includes: converting a signal received by a restart pin of the timing controller from a high level to a low level; and converting the signal received by the restart pin of the timing controller from a low level to a high level.

In one embodiment of the method for updating MURA compensation data of the display panel provided by the present disclosure, the method further includes: reconnecting the timing controller to the memory; and restarting the timing controller.

Moreover, the present disclosure provides another method for updating MURA compensation data of a display panel, and this method includes: disconnecting a timing controller from a memory; disabling a MURA compensation function of the timing controller such that the image of the display panel is an original image without MURA compensation; erasing an original MURA compensation data in the memory and simultaneously obtaining a new MURA compensation data according to the original image of the display panel; writing the new MURA compensation data into the memory; reconnecting the timing controller to the memory; enabling the MURA compensation function of the timing controller, and again reading data in the memory by the timing controller.

In one embodiment of the method for updating MURA compensation data of the display panel provided by the present disclosure, the timing controller is connected to the memory through a SPI circuit to read the data in the memory. The step of disconnecting the timing controller from the memory includes: converting a SPI enable signal received by a SPI enable pin of the timing controller from a high level to a low level so that the SPI circuit is shut down. In addition, the step of reconnecting the timing controller to the memory includes: converting the SPI enable signal received by the SPI enable pin of the timing controller from a low level to a high level so that so that the SPI circuit is started up.

In one embodiment of the method for updating MURA compensation data of the display panel provided by the present disclosure, the step of disabling the MURA compensation function of the timing controller includes: automatically disabling the MURA compensation function by the timing controller when the SPI enabling signal received by the timing controller is converted from a high level to a low level. In addition, the step of enabling the MURA compensation function of the timing controller includes: automatically enabling the MURA compensation function by the timing controller when the SPI enabling signal received by the timing controller is converted from a low level to a high level.

In one embodiment of the method for updating MURA compensation data of the display panel provided by the present disclosure, the step of again reading data in the memory by the timing controller includes: again reading the data in the memory by the timing controller when the signal received by the restart pin of the timing controller is converted from a high level to a low level.

In one embodiment of the method for updating MURA compensation data of the display panel provided by the present disclosure, before the step of disconnecting the timing controller from the memory, the method further comprises: enabling a signal detection function of the timing controller when the signal received by the restart pin of the timing controller is converted from a low level to a high level.

The present disclosure at least has an advantage that, during the time when the original MURA compensation data in the memory is erased, a new MURA compensation data can also be written into the memory such that the production efficiency of the display panel can be increased.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

The technical solutions in the embodiments of the disclosure will be described clearly and completely hereinafter with reference to the accompanying drawings in the embodiments of the disclosure so that those skilled in the art may better understand the solutions of the disclosure. Evidently, the described embodiments are merely some embodiments rather than all embodiments of the disclosure. All other embodiments obtained by persons of ordinary skill in the art based on the embodiments of the disclosure without creative efforts shall belong to the protection scope of the disclosure.

It needs to be noted that the terms "first", "second" and so on in the specification, the claims and the accompanying drawings of the disclosure are used for distinguishing similar objects, but are not necessarily used for describing a specific sequence or a precedence order. It should be understood that data used in this way are interchangeable in an appropriate condition, so that the embodiments described herein of the disclosure can be implemented in a sequence besides those illustrated or described herein.

Figure 1:
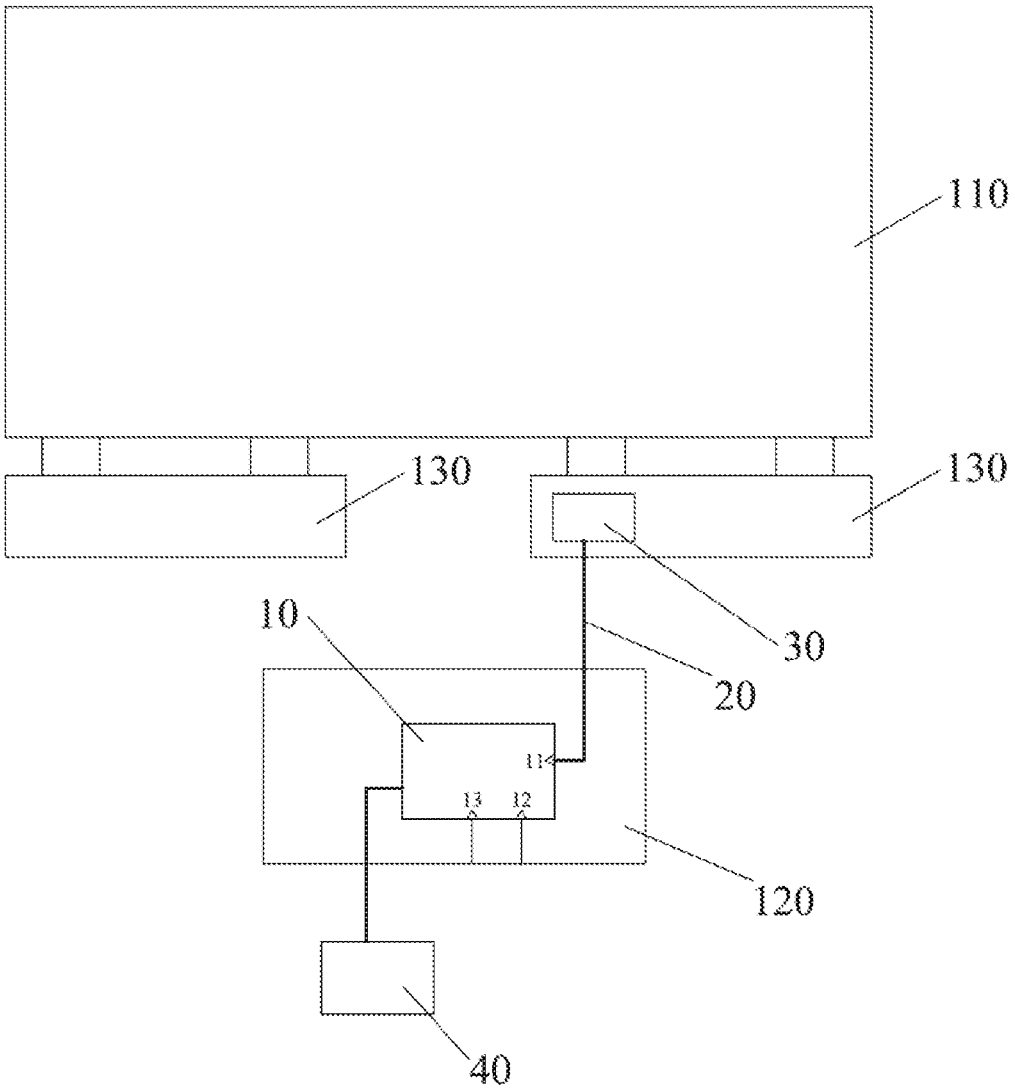
FIG. 1 is a schematic diagram of a compensation system providing MURA compensation data of a display panel according to an embodiment of the disclosure.

Referring to FIG. 1, a schematic diagram of a compensation system providing MURA compensation data of a display panel according to an embodiment of the disclosure is shown.

As shown in FIG. 1, the compensation system includes a timing controller (TCON IC) 10, a SPI (Serial Peripheral Interface; SPI) circuit 20, a memory 30, an I2C (Inter-Integrated Circuit; I2C) board 40.

The timing controller 10 is configured on a PCB (Printed Circuit Board; PCB) 120. The memory 30 is configured on a XBPCB 130, and the XBPCB 130 is connected to a display panel 110. In this embodiment, the memory 30 can be, for example, a flash, but it is not limited thereto.

The timing controller 10 includes a connecting pin 11, a SPI enable pin 12 and a restart pin 13. The connecting pin 11 is connected to the memory 30 through the SPI circuit 20, such that the timing controller 10 can read data in the memory 30. The SPI enable pin 12 receives a SPI enable signal. The SPI circuit 20 is shut down or started up according to the SPI enable signal. For example, when the SPI enable signal is at high level, the SPI circuit 20 is started up, but when the SPI enable signal is at low level, the SPI circuit 20 is shut down. The restart pin 13 receives a restart signal, and the timing controller 10 is enabled or disabled according to the restart signal.

MURA compensation data and the driving code of the timing controller 10 are stored in the memory 30. The driving code includes a register allocation data. According to the register allocation data, the MURA compensation function of the timing controller 10 is enabled or disabled. The timing controller 10 has a buffer. When the timing controller 10 reads the driving code from the memory 30 through the SPI circuit 20, the timing controller 10 stores the driving code its buffer. Thus, the MURA compensation function of the timing controller 10 can be enabled or disabled by revising the register allocation data stored in the buffer. Generally, the MURA compensation function of the timing controller 10 is predetermined to be enabled.

Figure 2:
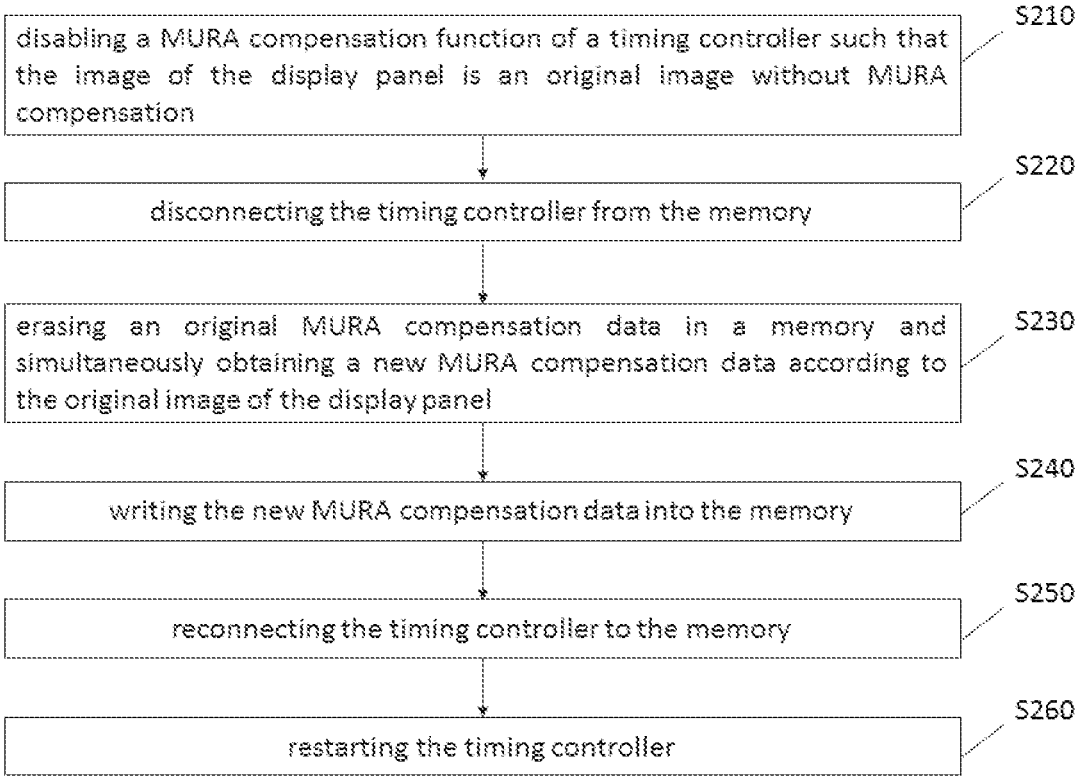
FIG. 2 is a flow chart of a method for updating MURA compensation data of a display panel according to an embodiment of the disclosure.
Figure 3:
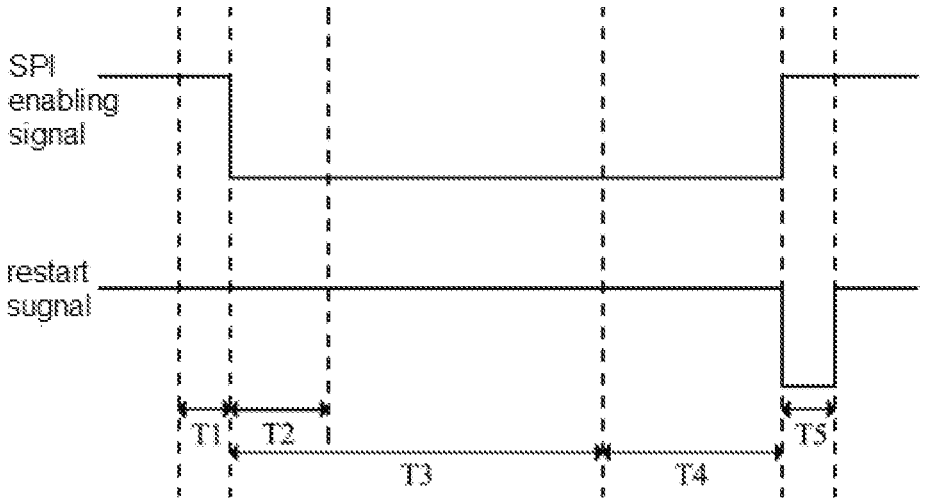
FIG. 3 is a waveform diagram of a SPI enable signal and a restart signal according to an embodiment of the disclosure.

FIG. 2 is a flow chart of a method for updating MURA compensation data of a display panel according to an embodiment of the disclosure, and FIG. 3 is a waveform diagram of a SPI enable signal and a restart signal according to an embodiment of the disclosure According to FIGS. 1-3, a method for updating MURA compensation data of a display panel includes steps as follows.

Step S210: the MURA compensation function of the timing controller 10 is disabled such that the image of the display panel 110 is an original image without MURA compensation. Step S210 corresponds to the time interval T1 (i.e. the time segment of disabling the MURA compensation function).

In step S210, a register allocation data in a buffer of the timing controller 10 is revised through an I2C board 40 such that the MURA compensation function of the timing controller 10 is disabled.

Step S220: the timing controller 10 is disconnected from the memory 30.

In step S220, a SPI enable signal received by the SPI enable pin 12 of the timing controller 10 is converted from a high level to a low level so that the SPI circuit 20 is shut down.

Step S230: an original MURA compensation data in a memory is erased, and simultaneously a new MURA compensation data is obtained according to the original image of the display panel. As shown in FIG. 3, in the time interval T2 (i.e. the time segment of erasing the original MURA compensation data) and in the time interval T3 (i.e. the time segment of obtaining the new MURA compensation data), the SPI enable signal is always at a low level, the MURA compensation function of the timing controller 10 is always disabled, and the image of the display panel 110 is an original image without MURA compensation. According to step S230, during the time when the original MURA compensation data in the memory is erased, a new MURA compensation data is simultaneously written into the memory (i.e. the time interval T3 fully overlaps the time interval T2). In this manner, the time interval T2 can be very well used.

Step S240: the new MURA compensation data is written into the memory. As shown in FIG. 3, in the time interval T4 (i.e. the time segment of writing the new MURA compensation data in to the memory), the SPI enable signal is always at a low level. The sum of the time interval T3 and the time interval T4 is longer than the time interval T2. In other words, the sum of the time segment of obtaining the new MURA compensation data and the time segment of writing the new MURA compensation data in to the memory is longer than the time segment of erasing the original MURA compensation data.

Step S250: the timing controller 10 is reconnected to the memory 30.

In step S250, the SPI enable signal received by the SPI enable pin 12 of the timing controller 10 is converted from a low level to a high level so that the SPI circuit 20 is started up.

Step S260: restarting the timing controller 10 is restarted. Step S260 corresponds to the time interval T5 (i.e. the time segment of restarting the timing controller 10). It should be noted that, after the timing controller 10 is restarted, the MURA compensation function of the timing controller 10 is predetermined to be enabled.

In step S260, a signal received by the restart pin 13 of the timing controller 10 is converted from a high level to a low level. After a predetermined time, the signal received by the restart pin 13 of the timing controller 10 is converted from a low level to a high level. It should be noted that, the predetermined time is short.

Briefly, the updating of the MURA compensation data is mainly completed by steps S210-S240. Step S250 and step S260 are for reconnecting the timing controller 10 to the memory 30 and for restarting the timing controller 10. Thus, in other embodiments, step S250 and step S260 can be omitted.

Figure 4:
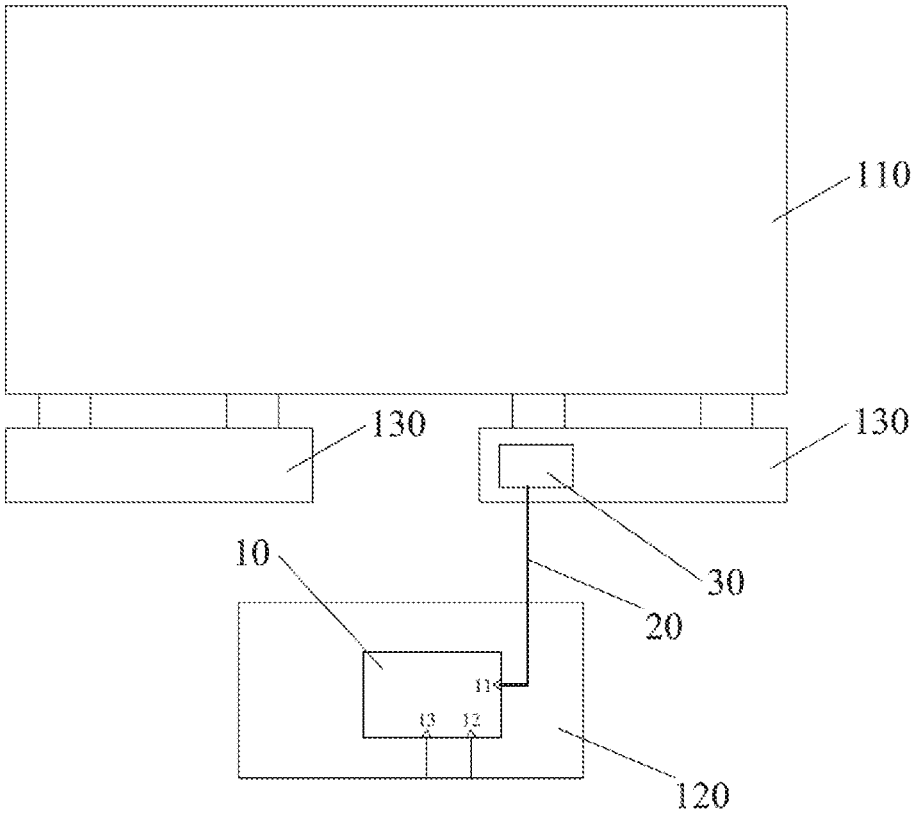
FIG. 4 is a schematic diagram of a compensation system providing MURA compensation data of a display panel according to another embodiment of the disclosure.

Referring to FIG. 4, a schematic diagram of a compensation system providing MURA compensation data of a display panel according to another embodiment of the disclosure is shown.

As shown in FIG. 4, the compensation system includes a timing controller (TCON IC) 10, a SPI (Serial Peripheral Interface; SPI) circuit 20 and a memory 30.

The timing controller 10 is configured on a PCB (Printed Circuit Board; PCB) 120. The memory 30 is configured on a XBPCB 130, and the XBPCB 130 is connected to a display panel 110. In this embodiment, the memory 30 can be, for example, a flash, but it is not limited thereto.

The timing controller 10 includes a connecting pin 11, a SPI enable pin 12 and a restart pin 13. The connecting pin 11 is connected to the memory 30 through the SPI circuit 20, such that the timing controller 10 can read data in the memory 30. The SPI enable pin 12 receives a SPI enable signal. The SPI circuit 20 is shut down or started up according to the SPI enable signal. For example, when the SPI enable signal is at high level, the SPI circuit 20 is started up, but when the SPI enable signal is at low level, the SPI circuit 20 is shut down. The restart pin 13 receives a restart signal, and the timing controller 10 is enabled or disabled according to the restart signal.

MURA compensation data and the driving code of the timing controller 10 are stored in the memory 30. The timing controller 10 read the driving code and the MURA compensation data from the memory 30 through the SPI circuit 20. In addition, in this embodiment, the timing controller 10 receives the SPI enable signal and accordingly disables or enables its MURA compensation function automatically.

Figure 5:
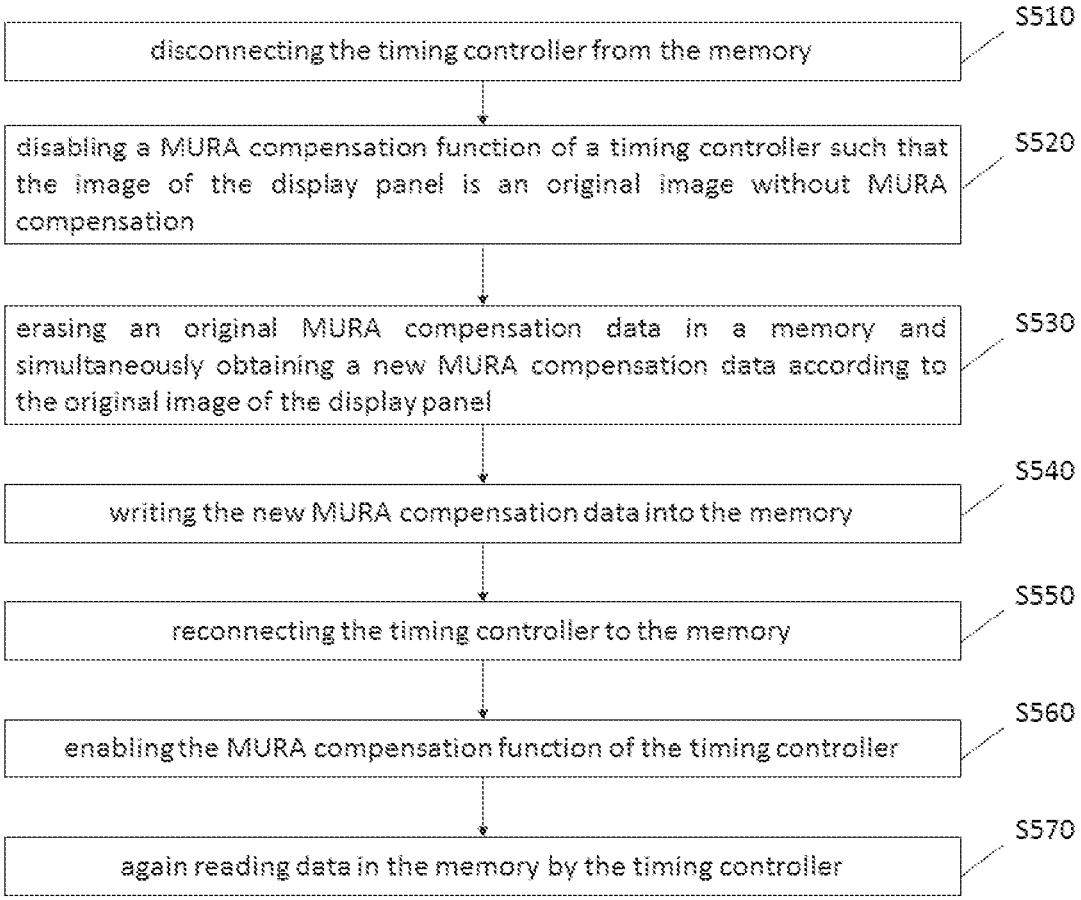
FIG. 5 is a flow chart of a method for updating MURA compensation data of a display panel according to another embodiment of the disclosure.
Figure 6:
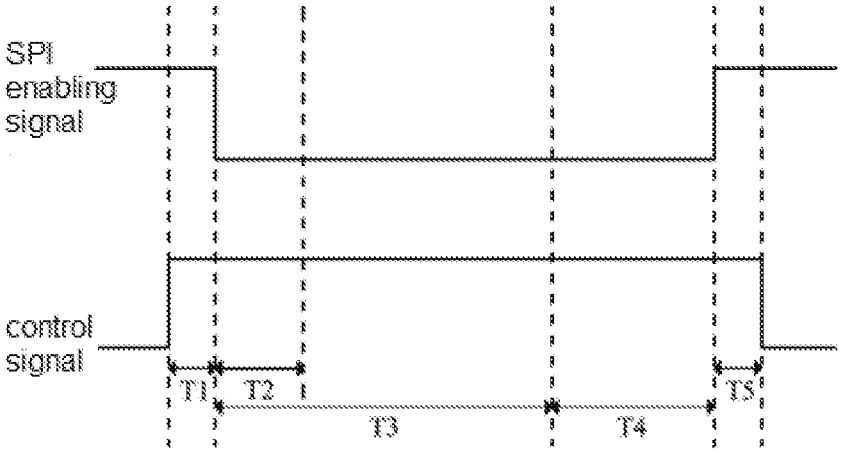
FIG. 6 is a waveform diagram of a SPI enable signal and a control signal according to another embodiment of the disclosure.

FIG. 5 is a flow chart of a method for updating MURA compensation data of a display panel according to another embodiment of the disclosure, and FIG. 6 is a waveform diagram of a SPI enable signal and a control signal according to another embodiment of the disclosure.

According to FIGS. 4-6, the method for updating MURA compensation data of a display panel provided by this embodiment includes steps as follows.

Step S510: the timing controller 10 is disconnected from the memory 30.

In step S510, a SPI enable signal received by the SPI enable pin 12 of the timing controller 10 is converted from a high level to a low level so that the SPI circuit 20 is shut down.

Step S520: the MURA compensation function of the timing controller 10 is disabled such that the image of the display panel 110 is an original image without MURA compensation.

In step S520, the timing controller 10 automatically disables its MURA compensation function when the SPI enable signal received by the timing controller 10 is converted from a high level to a low level.

Step S530: an original MURA compensation data in a memory is erased, and simultaneously a new MURA compensation data is obtained according to the original image of the display panel. As shown in FIG. 6, in the time interval T2 (i.e. the time segment of erasing the original MURA compensation data) and in the time interval T3 (i.e. the time segment of obtaining the new MURA compensation data), the SPI enable signal is always at a low level, the MURA compensation function of the timing controller 10 is always disabled, and the image of the display panel 110 is an original image without MURA compensation. According to step S530, during the time when the original MURA compensation data in the memory is erased, a new MURA compensation data is simultaneously written into the memory (i.e. the time interval T3 fully overlaps the time interval T2). In this manner, the time interval T2 can be very well used.

Step S540: the new MURA compensation data is written into the memory. As shown in FIG. 6, in the time interval T4 (i.e. the time segment of writing the new MURA compensation data in to the memory), the SPI enable signal is always at a low level. The sum of the time interval T3 and the time interval T4 is longer than the time interval T2. In other words, the sum of the time segment of obtaining the new MURA compensation data and the time segment of writing the new MURA compensation data in to the memory is longer than the time segment of erasing the original MURA compensation data.

Step S550: the timing controller 10 is reconnected to the memory 30.

In step S550, the SPI enable signal received by the SPI enable pin 12 of the timing controller 10 is converted from a low level to a high level so that the SPI circuit 20 is started up.

Step S560: the MURA compensation function of the timing controller 10 is enabled.

In step S560, the timing controller 10 automatically enables its MURA compensation function, when the SPI enable signal received by the timing controller 10 is converted from a low level to a high level.

Step S570: the timing controller 10 again reads data (including the driving code and the new MURA compensation data) from the memory 30. Step S570 corresponds to the time interval T5 (i.e. the time segment of reading data from the memory 30).

In step S570, the timing controller 10 again reads the data in the memory 30 when the control signal received by the restart pin 13 of the timing controller 10 is converted from a high level to a low level. It should be noted that, the timing controller 10 disables its signal detection function when the signal received by the restart pin 13 of the timing controller 10 is converted from a high level to a low level.

Moreover, before step S510, when the control signal received by the restart pin 13 of the timing controller 10 is converted from a low level to a high level, the timing controller 10 enables its signal detection function. This corresponds to the time interval T1 (i.e. the time segment of disabling the MURA compensation function).

According to the above descriptions, in each of the embodiments provided by the present disclosure, during the time when the original MURA compensation data in the memory is erased, a new MURA compensation data can simultaneously be written into the memory such that the time segment of erasing the original MURA compensation data is very well used and the production efficiency of the display panel is thus increased.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A method for updating MURA compensation data of a display panel, comprising:

disabling a MURA compensation function of a timing controller such that the image of the display panel is an original image without MURA compensation, wherein the timing controller is connected to a memory;

disconnecting the timing controller from the memory;

erasing an original MURA compensation data in a memory and simultaneously obtaining a new MURA compensation data according to the original image of the display panel; and writing the new MURA compensation data into the memory.

2. The method according to claim 1, wherein the step of disabling the MURA compensation function of the timing controller includes:

revising a register allocation data in a buffer of the timing controller through an I2C board such that the MURA compensation function of the timing controller is disabled;

wherein the MURA compensation function of the timing controller is disabled or enabled according to the register allocation data.

3. The method according to claim 2, wherein the timing controller is connected to the memory through a SPI circuit, and the step of disconnecting the timing controller from the memory includes:

converting a SPI enable signal received by a SPI enable pin of the timing controller from a high level to a low level so that the SPI circuit is shut down;

wherein the timing controller is reconnected to the memory when the SPI enable signal received by the SPI enable pin of the timing controller from a low level to a high level.

4. The method according to claim 1, wherein the timing controller is connected to the memory through a SPI circuit, and the step of disconnecting the timing controller from the memory includes:

converting a SPI enable signal received by a SPI enable pin of the timing controller from a high level to a low level so that the SPI circuit is shut down;

wherein the timing controller is reconnected to the memory when the SPI enable signal received by the SPI enable pin of the timing controller from a low level to a high level.

5. The method according to claim 1, further comprising:

restring the timing controller;

wherein the step of restring the timing controller includes:

converting a signal received by a restart pin of the timing controller from a high level to a low level; and converting the signal received by the restart pin of the timing controller from a low level to a high level.

6. The method according to claim 1, further comprising:

reconnecting the timing controller to the memory; and restarting the timing controller.

7. A method for updating MURA compensation data of a display panel, comprising:

disconnecting a timing controller from a memory;

disabling a MURA compensation function of the timing controller such that the image of the display panel is an original image without MURA compensation;

erasing an original MURA compensation data in the memory and simultaneously obtaining a new MURA compensation data according to the original image of the display panel;

writing the new MURA compensation data into the memory;

reconnecting the timing controller to the memory;

enabling the MURA compensation function of the timing controller; and again reading data in the memory by the timing controller.

8. The method according to claim 7, wherein the timing controller is connected to the memory through a SPI circuit to read the data in the memory;

wherein the step of disconnecting the timing controller from the memory includes:

converting a SPI enable signal received by a SPI enable pin of the timing controller from a high level to a low level so that the SPI circuit is shut down;

wherein the step of reconnecting the timing controller to the memory includes:

converting the SPI enable signal received by the SPI enable pin of the timing controller from a low level to a high level so that so that the SPI circuit is started up.

9. The method according to claim 8, wherein the step of disabling the MURA compensation function of the timing controller includes:

automatically disabling the MURA compensation function by the timing controller when the SPI enabling signal received by the timing controller is converted from a high level to a low level;

wherein the step of enabling the MURA compensation function of the timing controller includes:

automatically enabling the MURA compensation function by the timing controller when the SPI enabling signal received by the timing controller is converted from a low level to a high level.

10. The method according to claim 9, wherein before the step of disconnecting the timing controller from the memory, the method further comprises:

enabling a signal detection function of the timing controller when the signal received by the restart pin of the timing controller is converted from a low level to a high level.

11. The method according to claim 9, wherein before the step of disconnecting the timing controller from the memory, the method further comprises:

enabling a signal detection function of the timing controller when the signal received by the restart pin of the timing controller is converted from a low level to a high level.

12. The method according to claim 8, wherein the step of again reading data in the memory by the timing controller includes:

again reading the data in the memory by the timing controller when the signal received by the restart pin of the timing controller is converted from a high level to a low level.

* * * * *